United States Patent [19]

Bergmeister

[11] 4,391,167

[45] Jul. 5, 1983

[54] LIFT-TOP CAN OPENER

[76] Inventor: Josef J. Bergmeister, 620 Jones, San Francisco, Calif. 94102

[21] Appl. No.: 333,726

[22] Filed: Dec. 23, 1981

[51] Int. Cl.[3] ..... B67B 7/40

[52] U.S. Cl. ..... 81/3.46 R

[58] Field of Search ..... 81/3.46 R, 3.34, 3.1 R; 7/151

[56] References Cited

U.S. PATENT DOCUMENTS 4,253,352 3/1981 O'Neal ..... 81/3.46 R 4,257,287 3/1981 Dawson ..... 81/3.34

*Primary Examiner*—Roscoe V. Parker

*Attorney, Agent, or Firm*—Harvey B. Jacobson

[57] ABSTRACT

An elongated lever member is provided including first and second ends. The first end of the lever member defines a handle and the second end includes structure defining an endwise outwardly opening recess having a first narrow transverse dimension and a second wide transverse dimension several times as great as the first transverse dimension, the recess being provided to receive therein the left tab of a lift top can to thereby enable the lever member to be subsequently used as an operating lever to assist in lifting the lift tab. In addition, one side portion of the second end of the lever member includes structure defining a laterally outwardly offset hook opening toward the first end of the lever member, which hook may be engaged with a pop top tab in order to enable the latter to be subsequently at least initially displaced outwardly of the associated can end.

3 Claims, 5 Drawing Figures

LIFT-TOP CAN OPENER

BACKGROUND OF THE INVENTION

Persons who are required to open many pop top and lift top cans through out the working day find it difficult to do so due to their fingertip becoming sore and repeated breakage of their fingernails. Accordingly, a need exists for a tool by which a beverage can lift top or pop top may be manipulated to open the associated can.

BRIEF DESCRIPTION OF THE INVENTION

The can opener of the instant invention has been specifically designed to assist in the opening of lift top cans as well as pop top cans. A pop top can includes a tab portion which must be lifted upwardly away from the top of the can to a position enabling the insertion of a finger in a ring portion and then the ring portion must be pulled upwardly and free from the can in order to tear the tab therefrom. With a lift top can, the free end of a tab must be swung from a position closely overlying the top of the can to a position substantially perpendicular to the can. While most persons are fully capable of occasionally opening such a can, persons who must repeatedly open such cans develop sore fingers and break many fingernails.

The tool of the instant invention includes a first portion thereof for engaging a lift top tab and a second portion thereof for engaging a pop top tab. In addition, the second portion may also be used to raise a lift top tab and the first portion may be used to initially lift a pop top tab.

These together with other objects and advantages which will become subsequently apparent reside in the details of construction and operation as more fully hereinafter described and claimed, reference being had to the accompanying drawings forming a part hereof, wherein like numerals refer to like parts throughout.

DETAILED DESCRIPTION OF THE INVENTION

Figure 1:
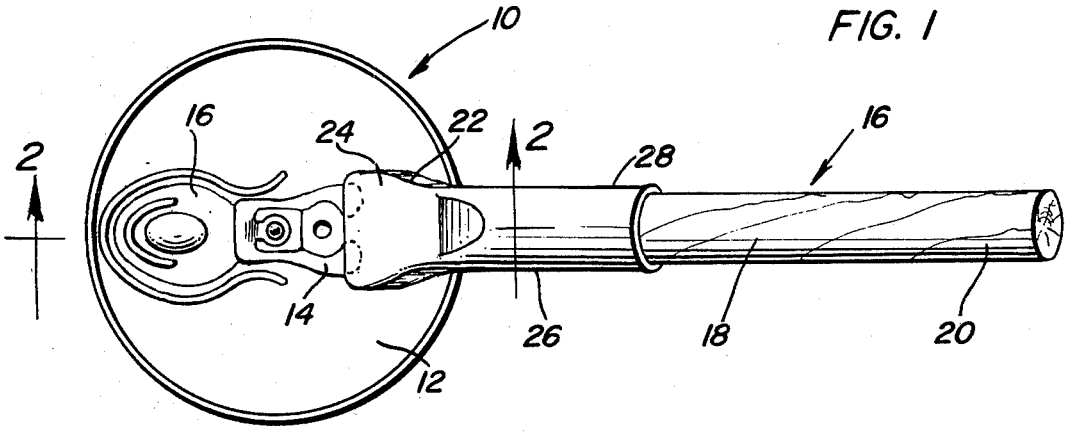
FIG. 1 is a top plan view of a lift top can with the tool of the instant invention engaged with the tab of the lift top can.

Referring now more specifically to the drawings, the numeral 10 generally designates a conventional form of lift top can including a top wall 12 having a lift top tab 14 and breakaway portion 16 supported therefrom.

The tool of the instant invention is referred to in general by the reference numeral 16 and includes an elongated lever member 18 having first and second ends 20 and 22. The first end 20 defines a handgrip and the second end 22 is defined by a flattened terminal end 24 of a sleeve 26 having its remote end 28 telescoped over and secured on the corresponding end of the lever member 18.

The flattened terminal end 24 defines an endwise outwardly opening recess 30 which includes first and second, narrow and wide, transverse dimensions with the wide transverse dimension being several times the narrow transverse dimension. In addition, the flattened terminal end includes a laterally struck portion 32 defining a rearwardly opening hook.

Figure 2:
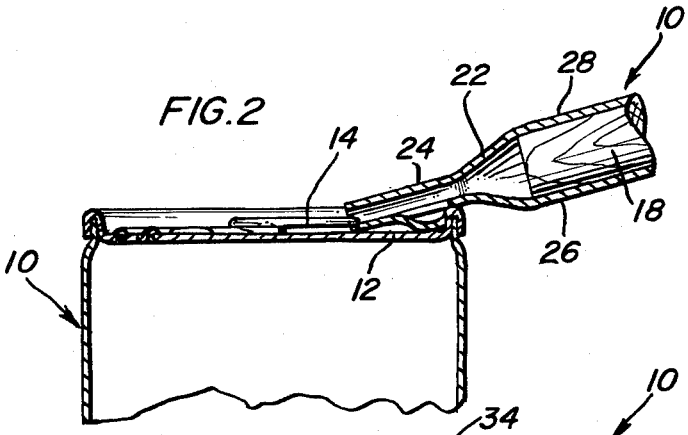
FIG. 2 is a vertical sectional view taken substantially upon the plane indicated by the section line 2—2 of FIG. 1.
Figure 3:
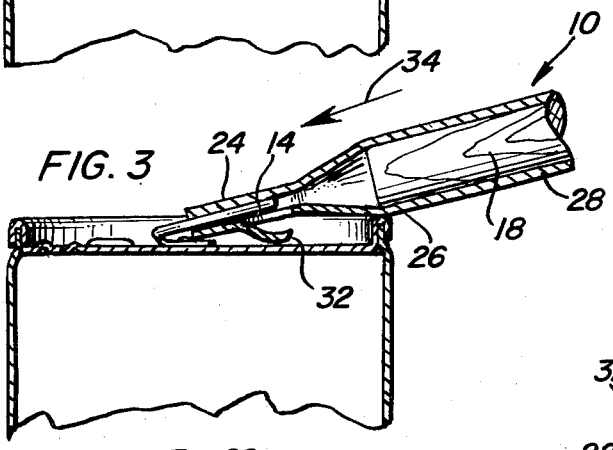
FIG. 3 is a sectional view similar to FIG. 3 illustrating the tool fully engaged with and in position having initially raised the tab of a lift top can.
Figure 4:
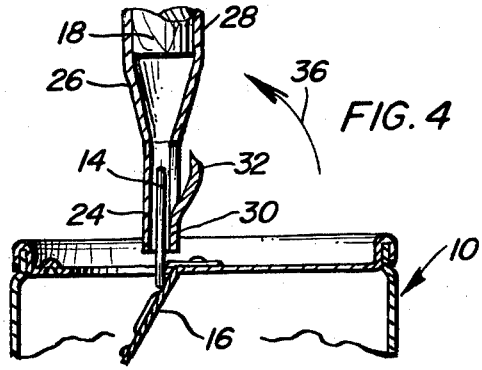
FIG. 4 is a further sectional view similar to FIGS. 2 and 3 of the drawings illustrating the position of the tool after having been utilized to fully lift the tab if a lift top can.
Figure 5:
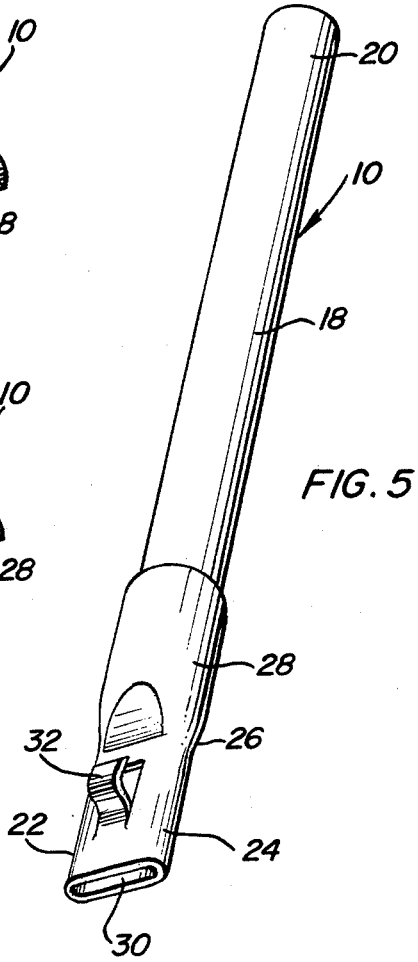
FIG. 5 is an underside perspective view of the tool illustrating the pop top tab engaging hook thereon.

In operation, the tool 10 is initially positioned in the manner illustrated in FIG. 2 of the drawings with the open end of the recess 30 registered with and at least initially receiving the free end of the lift top tab 14 therein. Thereafter, the tool 10 is longitudinally advanced in the direction of the arrow 34 in FIG. 3 of the drawings so as to fully engage the lift top tab 14 within the recess 30. Subsequently, the lever member 18 is swung in the direction of the arrow 36 illustrated in FIG. 4 of the drawings to swing the lift top tab 14 to the vertical position thereof illustrated in FIG. 4 of the drawings and cause the breakaway portion 16 to be downwardly displaced into the interior of the top of the can 10.

If for any reason the free end of the lift top tab 14 is not sufficiently spaced from the top wall 12 of the can 10 to enable the recess 30 to initially receive the free end of the lift top tab 14 therein in the manner illustrated in FIG. 2 of the drawings, the free end of the lift top tab 14 may be engaged by the laterally struck portion or hook 32 with the tool 10 being oppositely inclined relative to the top wall 12 from that position thereof illustrated in FIG. 2. In this manner, the hook 32 may be engaged with the free end of the lift top tab 14 and utilized to at least initially upwardly displace the free end of the lift top tab 14 in order that the tab 14 may then be received within the recess 30 in the manner illustrated in FIG. 3 of the drawings. Further, the laterally struck tongue or hook portion 32 may also be used to engage and upwardly displace the ring portion of a pop top tab. Accordingly, the tool 10 may be used to great advantage by bartenders and other persons who must repeatedly open lift top tab equipped cans or pop top cans throughout the working day.

The foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as new is as follows:

1. A lift top can opener including an elongated lever member defining first and second ends, said first end defining an elongated handle and said second end including recess means defining an endwise outwardly opening recess having a first narrow cross sectional dimension and a second wide cross sectional dimension several times the first narrow dimension, said recess being adapted to receive therein the lift tab of a top can with said lever member thereafter being usable as an operating lever to assist in lifting the lift tab, said elongated handle including at least one cylindrical end, said recess means including a cylindrical sleeve having one partially flattened end and the other end of said sleeve being snugly telescoped over said one cylindrical end of said handle for stationary support of said sleeve from said handle, said recess being defined within said partially flattened end, one of the flattened sides of said partially flattened end including an integral laterally outwardly struck portion defining a hook spaced laterally outward of said one flattened side and opening toward the other end of said sleeve.

2. The opener of claim 1 wherein said sleeve comprises an aluminum sleeve.

3. The opener of claim 2 wherein said elongated handle comprises a wooden dowel.

* * * * *